United States Patent [19]

Kazuyuki

[11] Patent Number: 4,752,759

[45] Date of Patent: Jun. 21, 1988

[54] MAGNET PLUG

[76] Inventor: Tomita Kazuyuki, 12-7, Yamate-cho 2-chome, Suita-shi, Osaka, Japan

[21] Appl. No.: 115,036

[22] Filed: Oct. 30, 1987

[30] Foreign Application Priority Data

Sep. 11, 1987 [JP] Japan ..... 62-138300[U]

[51] Int. Cl.[4] ..... H01F 7/02

[52] U.S. Cl. ..... 335/305; 335/302

[58] Field of Search ..... 335/285, 302, 303, 305

[56] References Cited

U.S. PATENT DOCUMENTS

| | | | |
|---|---|---|---|
| 2,878,342 | 3/1959 | Arthur | 335/305 X |
| 3,373,352 | 3/1968 | Huigens | 335/305 X |
| 3,411,120 | 11/1968 | Miyata | 335/302 |

*Primary Examiner*—George Harris

*Attorney, Agent, or Firm*—Wenderoth, Lind & Ponack

[57] ABSTRACT

The known magnet plug in which a cylindrical permanent magnet is fitted in and secured to a recess formed in a top surface of a threaded plug main body, is improved so that the permanent magnet can be firmly secured to the plug main body without damaging the threaded portion of the plug main body nor without magnetizing the threaded portion by the plug main body. The improvements reside in that a hollow cylindrical piece having a smaller outer diameter than that of the threaded portion of the plug main body is projected from the tip end surface of the threaded portion, a permanent magnet piece having an annular step formed on its outer peripheral surface has its bottom portion fitted in the hollow cylindrical piece, and the permanent magnet piece is fixedly secured to the plug main body by shrivelling the entire peripheral wall of the hollow cylindrical piece into the annular step.

1 Claim, 2 Drawing Sheets

MAGNET PLUG

BACKGROUND OF THE INVENTION

1. Field of the Invention

The present invention relates to a magnet plug mounted in a gear box or the like to adsorb and remove iron powder or the like mixed in the oil within the gear box.

2. Description of the Prior Art

A magnet plug is constructed by fitting and fixedly securing a permanent magnet in and to a recess formed in a tip end surface of a plug main body to be threadedly mounted to a gear box or the like.

In the prior art, a magnet plug constructed by shrivelling a tip end edge of a plug main body against a permanent magnet piece fitted in a recess of the main body when the permanent magnet piece is fixedly secured to the plug main body, was proposed.

One example of such type of magnet plugs in the prior art is shown in FIGS. 6 to 8. With reference to these figures, a bottom end of a permanent magnet piece (c) is fitted in a recess (b) formed in a top end portion of a plug main body (a), and the magnet plug is completed by shrivelling a tip end edge of the plug main body in a spot-like manner into a stepped portion at the bottom of the permanent magnet piece (c) with shrivelling jigs applied directly to a number of locations of the periphery at the tip end of a threaded portion of the plug main body (a), as indicated by reference character (d).

In addition, another example of such type of magnet plugs in the prior art is shown in FIGS. 9 to 11. In the case of this construction, a tip end edge of a plug main body (a) is shrivelled into straight grooves (e) formed in the axial direction on the diametrically opposite outer circumferential surface portions of a permanent magnet piece (c) fitted in a recess (b) formed in a top end portion of the plug main body (a) by applying shrivelling jigs at two locations on the tip end edge of the threaded portion of the plug main body (a), as indicated by reference character (d').

In the above-described magnet plugs in the prior art, since the permanent magnet is fixed to the plug main body by spot-shrivelling, looseness between the plug main body and the permanent magnet piece is inevitable, and also as a shrivelling jig is applied directly to the threaded portion of the plug main body, distortion would be generated in the threaded portion by shrivelling, and in the worst case the plug main body would become unable to be screwed into a threaded bore in the gear case or the like.

Furthermore, as the bottom portion of the permanent magnet piece is directly fitted in the threaded portion of the plug main body, the threaded portion would be magnetized, and so, there exists a problem that the threaded portion of the plug as well as the threaded bore for mounting in the gear box or the like may be damaged by iron powder or the like adsorbed by the magnetized threaded portion.

It is therefore one object of the present invention to provide an improved magnet plug in which a permanent magnet piece can be firmly secured to a plug main body without damaging a threaded portion of the plug main body nor without magnetizing the plug main body.

According to one feature of the present invention, there is provided a magnet plug comprising a plug main body including a threaded portion, a hollow cylindrical piece projected from the tip end surface of the threaded portion of the plug main body and having a smaller outer diameter than that of the threaded portion, and a permanent magnet piece having an annular step formed on its outer peripheral surface with its bottom portion fitted in the hollow cylindrical piece and fixedly secured thereto by shrivelling the entire peripheral wall of the hollow cylindrical piece into the annular step.

According to the present invention, as described above, a hollow cylindrical piece having a smaller outer diameter than that of a threaded portion of a plug main body is projected from a tip end surface of the threaded portion of the plug main body, a bottom portion of a permanent magnet piece is fitted in the hollow cylindrical piece, then the entire peripheral wall of the hollow cylindrical piece is shrivelled into the annular step formed on the outer peripheral surface of the bottom portion of the permanent magnet piece without influencing the threaded portion of the plug main body, and owing to the fact that the hollow cylindrical piece is shrivelled against the permanent magnet piece over their entire circumference, the permanent magnet piece can be firmly and fixedly secured to the plug main body without producing any looseness therebetween.

Moreover, since the permanent magnet piece is fitted in and fixedly secured to the hollow cylindrical piece projected from the tip end surface of the threaded portion of the plug main body rather than being fitted within the threaded portion as is the case with the prior art, the threaded portion of the plug main body would not be magnetized by the permanent magnet piece, and therefore, it would never occur that a threaded bore in a gear box or the like for receiving the magnet plug as well as the threaded portion of the plug main body are damaged by iron powder adsorbed on the magnetized threaded portion of the plug main body.

The above-mentioned and other objects, features and advantages of the present invention will become more apparent by reference to the following description of preferred embodiments of the invention taken in conjunction with the accompanying drawings.

DESCRIPTION OF THE PREFERRED EMBODIMENTS

Figure 1:
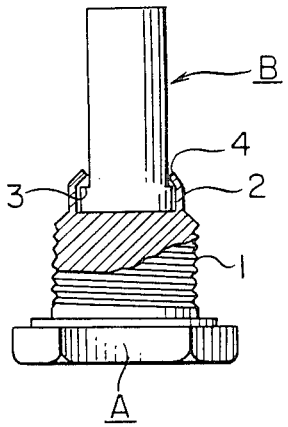
FIG. 1 is a front view partly in longitudinal cross-section of one preferred embodiment of a magnet plug according to the present invention.
Figure 2:
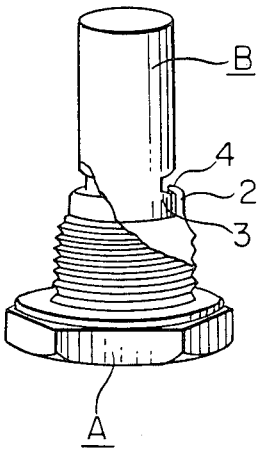
FIG. 2 is a perspective view partly cut away of the same preferred embodiment.
Figure 3:
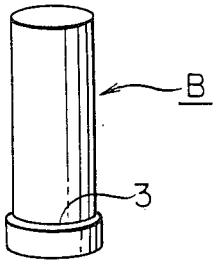
FIG. 3 is a perspective view of a permanent magnet piece used in the embodiment shown in FIGS. 1 and 2.

Now, the present invention will be described in greater detail in connection to the preferred embodiments illustrated in the accompanying drawings. In FIGS. 1 to 3, reference character (A) designates a plug main body, and a hollow cylindrical piece (2) having a smaller outer diameter than that of a threaded portion (1) of the plug main body (A) is integrally provided with the plug main body (A) as projected from a tip end surface of the threaded portion (1). Reference character (B) designates a permanent magnet piece, whose bottom end portion is provided with an annular step (3).

The bottom end portion of the permanent magnet piece (B) is fitted in the hollow cylindrical piece (2), then the entire circumferential wall of the hollow cylindrical piece (2) is shrivelled into the annular step (3) of the permanent magnet piece (B) by means of a shrivelling jig fitted around the outer circumference of the permanent magnet piece (B), and thereby the permanent magnet piece (B) is firmly and fixedly secured to the hollow cylindrical piece (2), hence to the plug main body (A), so that no looseness may arise therebetween. In FIGS. 1 and 2, reference numeral (4) designates the shrivelled portion.

During this shrivelling operation, since the outer diameter of the hollow cylindrical piece (2) has a smaller outer diameter than that of the threaded portion (1) of the plug main body (A) and the hollow cylindrical is projected from the threaded portion (1), distortion would not be generated in the threads of the threaded portion by the shrivelling jig.

Moreover, as the permanent magnet piece (B) is fitted in the hollow cylindrical piece (2) projected from the tip end of the threaded portion (1) rather than within the threaded portion, the threaded portion would not be magnetized by the permanent magnet piece (B).

Figure 4:
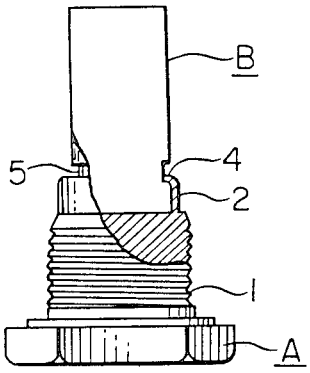
FIG. 4 is a front view partly in longitudinal cross-section of another preferred embodiment of a magnet plug according to the present invention.
Figure 5:
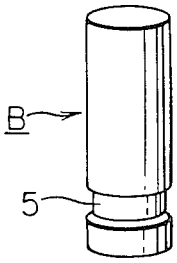
FIG. 5 is a perspective view of a permanent magnet piece used in the embodiment shown in FIG. 4.
Figure 6:
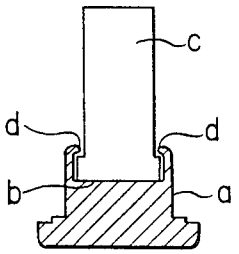
FIG. 6 is a longitudinal cross-section view showing one example, of magnet plugs in the prior art.
Figure 9:
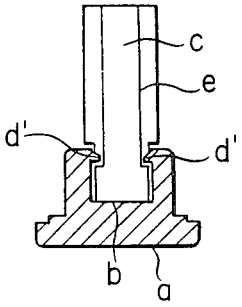
FIG. 9 is a longitudinal cross-section view showing another example of magnet plugs in the prior art.
Figure 7:
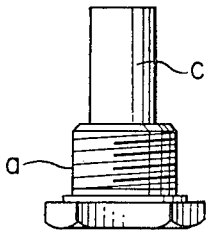
FIG. 7 is a front view of the same magnet plug.
Figure 10:
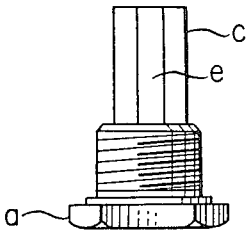
FIG. 10 is a front view of the magnet plug in FIG. 9.
Figure 8:
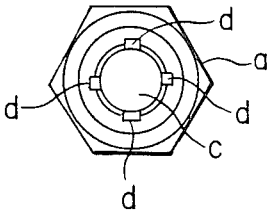
FIG. 8 is a plan view of the same magnet plug.
Figure 11:
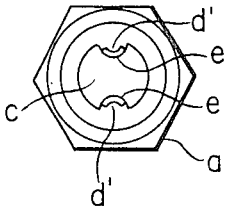
FIG. 11 is a plan view of the same magnet plug.

In a modified embodiment of the present invention illustrated in FIGS. 4 and 5, an annular groove (5) is formed in the bottom end portion of a permanent magnet piece (B) instead of an annular step (3) in the first preferred embodiment, and the entire circumferential wall of the hollow cylindrical piece (2) is shrivelled into the lower step of the annular groove (5). In FIGS. 4 and 5, component parts equivalent to those included in the first preferred embodiment are given like reference numerals, and further description thereof will be omitted.

As will be obvious from the above description, according to the present invention, owing to the fact that a recess for fitting and mounting a permanent magnet piece as provided in the prior art magnet plug is not formed in the threaded portion of the plug main body, but a hollow cylindrical piece having a smaller outer diameter than that of the threaded portion of the plug main body is integrally projected from the tip end surface of the threaded portion, a bottom end portion of a permanent magnet piece is fitted in the hollow cylindrical piece, and the entire circumferential wall of the hollow cylindrical piece is shrivelled into an annular step formed in the bottom end portion of the permanent magnet piece, the permanent magnet piece can be firmly and fixedly secured to the plug main body, and any looseness between the permanent magnet piece and the plug main body would not occur as is the case with the prior art magnet plug in which the permanent magnet was mounted to the plug main body by point shrivelling.

Furthermore, according to the present invention, since the permanent magnet piece is not fitted in the threaded portion of the plug main body but is fitted in the hollow cylindrical piece projected from the tip end surface of the threaded portion, the threaded portion of the plug main body would not be magnetized by the permanent magnet. Therefore, the threads of the threaded portion of the plug main body as well as the threads of the threaded bore in a gear box or the like adapted to receive the magnet plug would not be damaged by iron powder adsorbed by the magnetized threaded portion as is the case with the prior art.

Since many changes and modifications in design can be made in the above-described construction without departing from the spirit of the invention, all matter contained in the above description and illustrated in the accompanying drawings shall be interpreted to be illustrative and not as a limitation to the scope of the invention.

What is claimed is:

1. A magnet plug comprising a plug main body including a threaded portion, a hollow cylindrical piece projected from the tip end surface of the threaded portion of said plug main body and having a smaller outer diameter than that of said threaded portion, and a permanent magnet piece having an annular step formed on its outer peripheral surface with its bottom portion fitted in said hollow cylindrical piece and fixedly secured thereto by shrivelling the entire peripheral wall of said hollow cylindrical piece into said annular step.

* * * * *